US006299939B1

(12) United States Patent
DuBois et al.

(10) Patent No.: US 6,299,939 B1
(45) Date of Patent: Oct. 9, 2001

(54) METHOD OF PREPARING A DIAPHRAGM FOR AN ELECTROLYTIC CELL

(75) Inventors: Donald W. DuBois, Irwin; Bernard A. Maloney, Murrysville, both of PA (US)

(73) Assignee: PPG Industries Ohio, Inc., Cleveland, OH (US)

( * ) Notice: Subject to any disclaimer, the term of this patent is extended or adjusted under 35 U.S.C. 154(b) by 0 days.

(21) Appl. No.: 09/560,599

(22) Filed: Apr. 28, 2000

(51) Int. Cl.[7] ..... B05D 5/00
(52) U.S. Cl. ..... 427/243; 427/247; 204/296
(58) Field of Search ..... 427/243, 244, 427/245, 247; 521/27; 204/296

(56) References Cited

U.S. PATENT DOCUMENTS

| | | | |
|---|---|---|---|
| 3,980,547 | 9/1976 | Kunkle | 204/301 |
| 4,003,811 | 1/1977 | Kunkle | 204/180 R |
| 4,048,038 | 9/1977 | Kunkle | 204/180 R |
| 4,110,153 | 8/1978 | Rechlicz | 156/633 |
| 4,110,189 | 8/1978 | Kunkle et al. | 204/180 R |
| 4,132,626 | 1/1979 | Kunkle | 204/301 |
| 4,170,537 | 10/1979 | Simmons | 204/295 |
| 4,170,538 | 10/1979 | Simmons | 204/295 |
| 4,170,539 | 10/1979 | Simmons | 204/295 |
| 4,253,935 | 3/1981 | Simmons | 204/295 |
| 4,311,566 | 1/1982 | McCann | 204/98 |
| 4,666,573 | 5/1987 | DuBois et al. | 204/98 |
| 4,680,101 | 7/1987 | Darlington et al. | 204/295 |
| 4,720,334 | 1/1988 | DuBois et al. | 204/296 |
| 5,188,712 | 2/1993 | Dilmore et al. | 204/98 |
| 5,192,401 | 3/1993 | DuBois et al. | 204/98 |
| 5,612,089 | 3/1997 | Dilmore et al. | 427/247 |
| 5,683,749 | 11/1997 | DuBois et al. | 427/243 |
| 6,059,944 | 5/2000 | DuBois et al. | 204/296 |

*Primary Examiner*—Bruce F. Bell
(74) *Attorney, Agent, or Firm*—Dennis G. Millman; James R. Franks

(57) ABSTRACT

A method of forming a liquid-permeable asbestos-free diaphragm for use in an electrolytic cell (e.g., a chlor-alkali cell) is described. The method comprises, (a) forming a liquid-permeable diaphragm base mat of asbestos-free material on a foraminous structure (e.g., a foraminous cathode structure); (b) drawing through the base mat a topcoat slurry comprising an aqueous medium (e.g., deionized water), water-insoluble inorganic particulate material (e.g., attapulgite clay) and alkali metal polyphosphate (e.g., tetrasodium pyrophosphate decahydrate); and (c) drying the formed diaphragm. The inorganic material of the topcoat slurry is deposited on and within the diaphragm base mat.

21 Claims, No Drawings

METHOD OF PREPARING A DIAPHRAGM FOR AN ELECTROLYTIC CELL

DESCRIPTION OF THE INVENTION

The present invention relates to a method of preparing a liquid-permeable asbestos-free diaphragm. An asbestos-free liquid-permeable base mat is formed on a foraminous structure, e.g., a foraminous cathode structure, and water-insoluble inorganic particulate material is deposited on and within the base mat by drawing a liquid topcoat slurry comprising an aqueous medium, water-insoluble inorganic particulate material and alkali metal polyphosphate through the base mat. Diaphragms made by the method of the present invention are useful in electrolytic cells, e.g., cells used to electrolytically convert aqueous alkali metal halide to aqueous alkali metal hydroxide and halogen.

The electrolysis of alkali metal halide brines, such as sodium chloride and potassium chloride brines, in electrolytic cells is a well known commercial process. Electrolysis of such brines results in the production of halogen, hydrogen and aqueous alkali metal hydroxide. In the case of sodium chloride brines, the halogen produced is chlorine and the alkali metal hydroxide is sodium hydroxide. The electrolytic cell typically comprises an anolyte compartment containing an anode, and a separate catholyte compartment containing a cathode assembly. The cathode assembly is typically comprised of a cathode and a liquid-permeable diaphragm, which partitions the electrolytic cell into the anolyte and catholyte compartments.

The electrolysis of brine typically involves charging an aqueous solution of the alkali metal halide salt, e.g., sodium chloride brine, to the anolyte compartment of the cell. The aqueous brine percolates through the liquid permeable diaphragm into the catholyte compartment and then exits from the cell. With the application of direct current electricity to the cell, halogen gas, e.g., chlorine gas, is evolved at the anode, hydrogen gas is evolved at the cathode and aqueous alkali metal hydroxide is formed in the catholyte compartment from the combination of alkali metal cations with hydroxide anions.

For the cell to operate properly it is required that the diaphragm, which partitions the anolyte and catholyte compartments, be sufficiently porous to allow the hydrodynamic flow of brine through it, while at the same time inhibiting the back migration of hydroxyl ions from the catholyte compartment into the anolyte compartment. The diaphragm should also (a) inhibit the mixing of evolved hydrogen and chlorine gases, which can pose an explosive hazard, and (b) possess low electrical resistance, i.e., have a low IR drop. Historically, asbestos has been a common diaphragm material used in these so-called chlor-alkali electrolytic diaphragm cells. Subsequently, asbestos in combination with various polymeric resins, particularly fluorocarbon resins (the so-called polymer-modified asbestos diaphragms), have been used as diaphragm materials.

Due in part to possible health and safety issues associated with air-borne asbestos fibers in other applications, the development of asbestos-free diaphragms for use in chlor-alkali electrolytic cells has been an area of ongoing investigation. Such diaphragms, which are often referred to as synthetic diaphragms, are typically fabricated from non-asbestos fibrous polymeric materials that are resistant to the corrosive environment of the operating chlor-alkali cell. Such materials are typically perfluorinated polymeric materials, e.g., polytetrafluoroethylene (PTFE). These synthetic diaphragms may also contain various other modifiers and additives, such as inorganic fillers, pore formers, wetting agents, ion-exchange resins and the like. Examples of U.S. Patents describing synthetic diaphragms include U.S. Pat. Nos. 4,110,153, 4,170,537, 4,170,538, 4,170,539, 4,253,935, 4,311,566, 4,666,573, 4,680,101, 4,720,334, 5,188,712, and 5,192,401.

It is known that synthetic diaphragms for chlor-alkali cells having improved performance can be prepared by coating and/or impregnating them with inorganic materials. However, the surface and/or the degree of inorganic particulate impregnation of such coated diaphragms can be less than uniform. In some instances, the nonuniformity of the coated diaphragm may result in lower than desired electrolytic cell efficiencies, e.g., low caustic efficiencies in the case of chlor-alkali cells.

U.S. Pat. No. 5,612,089 describes a method of preparing asbestos-free diaphragms for use in chlor-alkali electrolytic cells. The diaphragms of the '089 patent are described as being prepared by establishing a liquid permeable asbestos-free base mat on a cathode structure, drawing through the base mat a liquid dispersion comprising inorganic particulate material dispersed in alkali metal chloride brine containing a wetting amount of organic surfactant, and drying the formed diaphragm.

U.S. Pat. No. 5,683,749 describes the preparation of asbestos-free diaphragms for chlor-alkali electrolytic cells used in chlor-alkali cells. The '749 patent describes preparing an asbestos-free diaphragm by forming an asbestos-free base mat on a cathode structure, drawing through the base mat a slurry of inorganic particulate material dispersed in a strongly alkaline alkali metal hydroxide solution, and drying the formed diaphragm.

U.S. Pat. Nos. 3,980,547, 4,003,811, 4,048,038, 4,110,189 and 4,132,189 describe the electrokinetic separation of clay particles from an aqueous suspension of clay particles. The suspension of clay particles is described in the '547, '811, '038, U.S. Pat. Nos. 4,110,189 and 4,132,189 as being formed by dispersing clay particles in water with tetrasodium pyrophosphate.

In accordance with the present invention there is provided a method of forming a liquid-permeable asbestos-free diaphragm for use in an electrolytic cell, said method comprising:

(a) forming on a foraminous structure a liquid-permeable diaphragm base mat of asbestos-free material comprising fibrous synthetic polymeric material resistant to the environment of said electrolytic cell;

(b) drawing through said diaphragm base mat a liquid topcoat slurry comprising an aqueous medium, water-insoluble inorganic particulate material, and alkali metal polyphosphate, thereby to deposit inorganic material on and within said diaphragm base mat; and (c) drying the resultant liquid-permeable asbestos-free diaphragm.

Other than in the operating examples, or where otherwise indicated, all numbers or expressions referring to quantities of ingredients, reaction conditions, etc. used in the specification and claims are to be understood as modified in all instances by the term "about."

DETAILED DESCRIPTION OF THE INVENTION

The water-insoluble inorganic particulate material that is present in the topcoat slurry may be selected from (i) oxides, borides, carbides, silicates and nitrides of valve metals, (ii)

clay mineral, and (iii) mixtures of (i) and (ii). As used herein and in the claims, the term "valve metal" is meant to be inclusive of vanadium, chromium, zirconium, niobium, molybdenum, hafnium, tantalum, titanium, tungsten and mixtures thereof. Of the valve metals, titanium and zirconium are preferred in the present invention. Of the valve metal oxides and valve metal silicates, valve metal oxides are preferred, e.g., titanium dioxide and zirconium oxide.

Clay minerals that may be present in the topcoat slurry in the method of the present invention include those that are naturally occurring hydrated silicates of metals, such as aluminum and magnesium, e.g., kaolin, meerschaums, augite, talc, vermiculite, wollastonite, montmorillonite, illite, glauconite, attapulgite, sepiolite and hectorite. Of the clay minerals, attapulgite and hectorite and mixtures thereof are preferred for use in the method of the present invention. Such preferred clays are hydrated magnesium silicates and magnesium aluminum silicates, which may also be prepared synthetically.

The mean particle size of the water-insoluble inorganic particulate material of the topcoat slurry may vary, but is typically in the range of from 0.1 microns to 20 microns, e.g., from 0.1 microns to 0.5 microns. In an embodiment of the present invention, the water-insoluble inorganic particulate material is an attapulgite clay. An attapulgite clay product having a mean particle size of about 0.1 microns and available from Engelhard Corporation under the trademark, "ATTAGEL®" has been found to be particularly useful in the practice of the method of the present invention.

The amount of water-insoluble inorganic particulate material present in the liquid topcoat slurry that is drawn through the diaphragm base mat formed in step (a) can vary over a wide range, depending on, for example, how much inorganic material is desired to be deposited on and within the base mat. Typically, the topcoat slurry contains inorganic material present in al amount of from 1 to 15 grams per liter of aqueous medium (gpl), e.g., 1 to 10 or 3 to 5 gpl.

The topcoat slurry also comprises alkali metal polyphosphate. Alkali metal polyphosphates useful in the present invention may be represented by the following general formula I, $$M_{e+2}P_eO_{3e+1}\cdot fH_2O$$

in which M is the alkali metal and may be selected from lithium, sodium, potassium, rubidium, cesium, francium and mixtures thereof; e is at least 2 (e.g., a number from 2 to 100, 2 to 10 or 2 to 5); and f is greater than or equal to 0 (e.g., 0, a number from 1 to 20 or from 1 to 10). More typically, the alkali metal of the alkali metal polyphosphate is selected from sodium, potassium and mixtures thereof. As used herein and in the claims, the term "alkali metal polyphosphate" refers to dehydrated alkali metal polyphosphates, hydrated alkali metal polyphosphates and mixtures of dehydrated and hydrated alkali metal polyphosphates.

Classes of alkali metal polyphosphates that may be used in the method of the present invention include, but are not limited to tetraalkali metal pyrophosphate (e.g., tetrasodium pyrophosphate and tetrapotassium pyrophosphate), alkali metal triphosphate (e.g., sodium triphosphate and potassium triphosphate), alkali metal tetraphosphate (e.g., sodium tetraphosphate), alkali metal hexametaphosphate (e.g., sodium hexametaphosphate) and mixtures thereof. In a preferred embodiment of the present invention the alkali metal polyphosphate is selected from tetraalkali metal pyrophosphate. Preferred tetraalkali metal pyrophosphates include dehydrated tetrasodium pyrophosphate, hydrated tetrasodium pyrophosphate (e.g., tetrasodium pyrophosphate decahydrate), and mixtures of dehydrated and hydrated tetrasodium pyrophosphates.

The liquid topcoat slurry typically contains alkali metal polyphosphate in an amount of at least 0.01 percent by weight, preferably at least 0.05 percent by weight, and more preferably at least 0.1 percent by weight, based on the total weight of the liquid topcoat slurry. Alkali metal polyphosphate is typically present in the topcoat slurry in an amount of less than 2 percent by weight, preferably less than 1 percent by weight, and more preferably less than 0.5 percent by weight, based on the total weight of the topcoat slurry. The topcoat slurry may contain alkali metal polyphosphate in an amount ranging between any of these upper and lower values, inclusive of the recited values.

The weight ratio of water-insoluble inorganic particulate material to alkali metal polyphosphate in the topcoat slurry is typically from 0.5:1 to 300:1, e.g., from 1:1 to 10:1. The water-insoluble inorganic particulate material and alkali metal polyphosphate are typically present in the topcoat slurry in an amount totaling from 0.5 percent by weight to 5 percent by weight, e.g., from 1 percent by weight to 3 percent by weight, the percent weights being based on the total weight of the topcoat slurry.

The aqueous medium of the liquid topcoat slurry may contain alkali metal halide, e.g., sodium chloride, and/or alkali metal hydroxide, e.g., sodium hydroxide, in amounts totaling from 0.01 percent by weight to 10 percent by weight, based on the total weight of the aqueous medium. In a preferred embodiment of the present invention, the aqueous medium is substantially free of alkali metal halide and alkali metal hydroxide. As used herein, and in the claims, by "substantially free of alkali metal halide and alkali metal hydroxide" is meant that the amount of alkali metal halide and alkali metal hydroxide present in the aqueous medium of the drawn slurry totals no more than 5 percent by weight, for example less than 1 percent by weight, based on the total weight of the aqueous medium. In a particularly preferred embodiment of the present invention, the aqueous medium of the drawn slurry is obtained from a source of either de-ionized or distilled water and is free of alkali metal halide and alkali metal hydroxide.

In an embodiment of the present invention, the aqueous medium of the topcoat slurry contains a wetting amount of organic surfactant selected from the groups consisting of nonionic, anionic and amphoteric surfactants and mixtures thereof. By "wetting amount" is meant that amount of organic surfactant that is at least sufficient to wet the diaphragm base mat during the deposition of the inorganic material on and within the base mat.

The organic surfactant is typically present in the aqueous medium in an amount of at least 0.01 percent by weight, preferably at least 0.02 percent by weight, and more preferably at least 0.05 percent by weight, based on the total weight of the water comprising the aqueous medium. The organic surfactant is also typically present in an amount of less than 1 percent by weight, preferably less than 0.5 percent by weight, and more preferably less than 0.3 percent by weight, based on the total weight of the water comprising the aqueous medium. The amount of organic surfactant present in the aqueous medium of the slurry drawn through the diaphragm base mat formed in step (a) may range between any combination of these values, inclusive of the recited values.

Organic surfactants from which the organic surfactant may be selected include, but are limited to, those represented by the following general formula II, $$R—(OC_2H_4)_m—(OC_3H_6)_n—(OC_4H_8)_p—R_1 \quad \text{II}$$

Depending on the composition of the end group $R_1$, general formula II may represent either nonionic or anionic surfactants. With reference to general formula II, R is an aliphatic hydrocarbon group, which preferably contains from 6 to 20 carbon atoms, more preferably from 8 to 15 carbon atoms, $—(OC_2H_4)_m—$ represents a poly(ethylene oxide) group, $—(OC_3H_6)_n—$ represents a poly(propylene oxide) group, $—(OC_4H_8)_p—$ represents a poly(butylene oxide) group, $R_1$ is the terminal group, which may be hydroxyl, chloride, $C_1$–$C_3$ alkyl, $C_1$–C5 alkoxy, benzyloxy ($—OCH_2C_6H_5$), phenoxy, phenyl ($C_1$–$C_3$)alkoxy, $—OCH_2C(O)OH$, sulfate, sulfonate or phosphate and the letters m, n and p are each an average number of from 0 to 50, provided that the sum of m, n and p is between 1 and 100.

When $R_1$ is $—OCH_2C(O)OH$, sulfate, sulfonate or phosphate, general formula II represents an anionic surfactant, in particular when these groups are present as salts. Salts of such terminal $R_1$ groups may be formed in the presence of a base, including for example, alkali metal hydroxide, e.g., sodium hydroxide, organic amine, e.g., triethylamine, and alkanolamine, e.g., mono-, di-, or triethanolamine.

Preferably, in general formula II, m, n and p are each a number of from 0 to 30, with the sum thereof being from 1 to 30; more preferably, m, n and p are each a number of from 0 to 10, with the sum thereof being from 1 to 20, more preferably from 1 to 10. Most preferably, n and p are 0, and $R_1$ is hydroxyl, i.e., the surfactants are ethoxylated aliphatic hydrocarbon materials, e.g., alcohols, i.e., alkanols. The aforedescribed surfactant materials are known to those skilled in the surfactant art and are either available commercially or can be synthesized by known synthesis procedures using commercially available starting materials.

Other surfactant materials that may be used in the method of the present invention include those surfactants that may be represented by formula II, wherein R is the group $(R')_t$-Ph-, wherein R' is an alkyl group containing from 5 to 20 carbons, e.g., 6 to 12 carbon atoms, Ph represents the bivalent or trivalent phenylene group, and the letter t is an integer of 0 to 2, preferably 1 or 2.

Further nonionic surfactant materials contemplated for use in the method of the present invention are the copolymers of ethylene oxide and propylene oxide, e.g., ethoxylated polyoxypropylene glycols and propoxylated polyethylene glycols. These materials may be random or block copolymers having a molecular weight of from 1000 to 16,000, and may be capped. These block polyols may be represented by the general formulae III and IV:

$$HO(C_2H_4O)_a(C_3H_6O)_b(C_2H_4O)_cH \quad \text{III}$$

$$HO(C_3H_6O)_b(C_2H_4O)_a(C_3H_6O)_dH \quad \text{IV}$$

wherein the letter b is chosen to provide a polyoxypropylene group of at least 900 molecular weight, e.g., 900–9000 molecular weight, more preferably 950 to 3500. The letter b is therefore equal to or greater than 15. In preparing the surfactants represented by general formula III, the polyoxypropylene group, i.e., the reaction of propylene oxide with propylene glycol, is ethoxylated such that the ethoxy group represented by a and c represent from 10 to 90 percent, e.g., 25 to 50 percent, of the total weight of the polyol.

In preparing the surfactant represented by general formula IV, the polyoxypropylene is ethoxylated so that the amount of ethoxy groups represent from 10 to 90 percent of the total weight of the polyol and then the polyol is capped with propylene oxide, e.g., d is a number of from 1 to 10.

Other polyols may be represented by the following general formula V, $$X(OC_2H_4)_q(OC_3H_6)_r(OC_4H_8)_sOX \quad \text{V}$$

wherein q, r and s are each average numbers of from 0 to 50, provided that the sum of q, r and s is between 1 and 100, and each X is hydrogen, chloride, $C_1$–$C_3$ alkyl, or benzyl. Preferably, X is hydrogen, and q, r and s are each average numbers of from 0 to 30, provided that the sum of q, r and s is between 1 and 50. An example of such nonionic surfactant materials are the PLURONIC® surfactants available from BASF Corporation.

Amphoteric surfactants are also contemplated for use in the method of the present invention. Amphoteric surfactants contain both acidic and basic hydrophilic moieties in their structure. The most commercially prominent amphoteric surfactants are derivatives of imidazoline. Examples include cocoamphopropionate, cocoamphocarboxy-propionate, cocoamphoglycinate, cocoamphocarboxyglycinate, cocoampho-propylsulfonate, and cocoamphocarboxy-propionic acid.

Another group of amphoteric surfactants contemplated for use in the method of the present invention include the Betaines and derivatives thereof, such as the Sulfobetaines. Typically, the common betaines may be represented by the following general formula VI,

VI

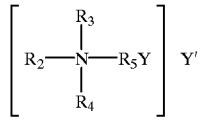

wherein $R_2$ is an alkyl group of from 1 to 20 carbon atoms, e.g., 1–15 carbon atoms, $R_3$ and $R_4$ are each alkyl groups of from 1 to 3 carbon atoms, e.g., methyl, $R_5$ is an alkylene group of from 1 to 3 carbon atoms, Y is the anionic radical comprising the internal salts, e.g., carboxylate ion [—C(O)O—], and sulfonate ion [$—SO_2O—$], Y' is the anionic radical comprising the external salt, e.g., hydrochloride. An example of such a betaine is (carboxymethyl) dodecyldimethyl-ammonium chloride, i.e., $[C_{12}H_{25}—N(CH_3)_2—CH_2COOH]^+Cl^-$.

Examples of the nonionic, anionic and amphoteric surfactants described herein (and their commercial sources) can be found listed in the publication, *McCutcheon's Emulsifiers and Detergents*, Volume 1, MC Publishing Co., McCutcheon Division, Glen Rock, N.J.

Preferably, the surfactant material is a nonionic material represented by general formula II wherein R is an aliphatic hydrocarbon group containing from 8 to 15, e.g., 12–15 carbon atoms, n and p are 0, m is a number averaging from 5 to 15, e.g., 9 to 10, and $R_1$ is chloride.

The topcoat slurry is drawn through the base mat by methods that are well known to the skilled artisan. Typically, the foraminous structure having a base mat of asbestos-free material formed thereon in step (a) of the present invention is dipped into a slurry of the topcoat ingredients, and the topcoat slurry is drawn through the base mat under vacuum. The density of water-insoluble inorganic material deposited on and within the base mat is typically from 0.01 to 0.1 pounds per square foot (0.05 to 0.5 kg/square meter), e.g., 0.05 pounds per square foot (0.24 kg/square meter).

The liquid-permeable diaphragm base mat formed in the first step of the method of the present invention may be made of any non-asbestos fibrous material or combination of fibrous materials known to those skilled in the chlor-alkali art, and may be prepared by art recognized techniques. Typically, chlor-alkali diaphragms are prepared by vacuum depositing the diaphragm base mat material from a liquid, e.g., aqueous, slurry onto a permeable substrate, e.g., a foraminous cathode. The foraminous cathode is electroconductive and may be a perforated sheet, a perforated plate, metal mesh, expanded metal mesh, woven screen, an arrangement of metal rods, or the like having equivalent openings typically in the range of from about 0.05 inch (0.13 cm) to about 0.125 inch (0.32 cm) in diameter. The cathode is typically fabricated of iron, iron alloy or some other metal resistant to the operating chlor-alkali electrolytic cell environment to which it is exposed, for example, nickel. The diaphragm material is typically deposited directly onto the cathode substrate in amounts ranging from about 0.3 to about 0.6 pound per square foot (1.5 to 2.9 kilogram per square meter) of substrate, the deposited diaphragm typically having a thickness of from about 0.075 to about 0.25 inches (0.19 to 0.64 cm).

Synthetic diaphragms used in chlor-alkali electrolytic cells are prepared predominantly from organic fibrous polymers. Useful organic polymers include any polymer, copolymer, graft polymer or combination thereof which is substantially chemically and mechanically resistant to the operating conditions in which the diaphragm is employed, e.g., chemically resistant to degradation by exposure to electrolytic cell chemicals, such as sodium hydroxide, chlorine and hydrochloric acid. Such polymers are typically the halogen-containing polymers that include fluorine. Examples of such halogen-containing polymers include, but are not limited to, fluorine-containing or fluorine- and chlorine-containing polymers, such as polyvinyl fluoride, polyvinylidene fluoride, polytetrafluoroethylene (PTFE), polyperfluoro(ethylene-propylene), polytrifluoroethylene, polyfluoroalkoxyethylene (PFA polymer), polychlorotrifluoroethylene (PCTFE polymer) and the copolymer of chlorotrifluoroethylene and ethylene (CTFE polymer). Of the halogen-containing polymers, polytetrafluoroethylene is preferred.

The organic polymer of the synthetic diaphragm is typically used in particulate form, e.g., in the form of particulates or fibers, as is well known in the art. In the form of fibers, the organic polymer material generally has a fiber length of up to about 0.75 inch (1.91 cm) and a diameter of from about 1 to 250 microns. Polymer fibers comprising the diaphragm may be of any suitable denier that is commercially available. A typical PTFE fiber used to prepare synthetic diaphragms is a ¼ inch (0.64 cm) chopped 6.6 denier fiber; however, other lengths and fibers of smaller or larger deniers may be used.

Organic polymeric materials in the form of microfibrils are also commonly used to prepare synthetic diaphragms. Such microfibrils may be prepared in accordance with the methods described in U.S. Pat. No. 5,030,403, the disclosure of which is incorporated herein by reference in its entirety. The fibers and microfibrils of the organic polymeric material, e.g., PTFE fibers and microfibrils, comprise the predominant portion of the diaphragm solids.

An important property of the synthetic diaphragm is its ability to wick (wet) the aqueous alkali metal halide brine solution which percolates through the diaphragm. To provide the property of wettability, the diaphragm of the present invention, and in particular, the diaphragm base mat, typically further comprises perfluorinated ion-exchange materials having sulfonic or carboxylic acid functional groups.

A preferred ion-exchange material is a perfluorinated material-prepared as an organic copolymer from the polymerization of a fluorovinyl ether monomer containing a functional group, i.e., an ion-exchange group or a functional group easily converted into an ion-exchange group, and a monomer chosen from the group of fluorovinyl compounds, such as vinyl fluoride, vinylidene fluoride, trifluoroethylene, tetrafluoroethylene, hexafluoroethylene, hexafluoropropylene, chlorotrifluoroethylene and perfluoro (alkylvinyl ether) with the alkyl being an alkyl group containing from 1 to 10 carbon atoms. A description of such ion-exchange materials can be found in U.S. Pat. No. 4,680,101 at column 5, line 36, through column 6, line 2, which disclosure is incorporated herein by reference.

An ion-exchange material with sulfonic acid functionality is particularly preferred. A perfluorosulfonic acid ion-exchange material (5 weight percent solution) is available from E. I. du Pont de Nemours and Company under the tradename NAFION resin. Other appropriate ion-exchange materials may be used to allow the diaphragm to be wetted by the aqueous brine fed to the electrolytic cell, as for example, the ion-exchange material available from Asahi Glass Company, Ltd. under the tradename FLEMION.

In addition to the aforedescribed fibers and microfibrils of halogen-containing polymers and the perfluorinated ion-exchange materials, the formulation used to prepare the diaphragm base mat may also include other additives, such as thickeners, surfactants, antifoaming agents, antimicrobial solutions and other polymers. In addition, materials such as fiberglass may also be incorporated into the diaphragm. An example of the components of a synthetic diaphragm material useful in a chlor-alkali electrolytic cell is found in Example 1 of U.S. Pat. 5,188,712, which disclosure is incorporated herein by reference.

Generally, the synthetic diaphragm contains a major amount of the polymer fibers and microfibrils. As the ion-exchange material is generally more costly than the fibers and microfibrils, the diaphragm preferably comprises from about 65 to about 90 percent by weight combined of the fibers and microfibrils and from about 0.5 to about 2 percent by weight of the ion-exchange material.

The liquid-permeable synthetic diaphragm base mat of the present invention is commonly prepared by depositing the components thereof onto a foraminous structure from an aqueous slurry. The foraminous structure is preferably a foraminous metal cathode structure that may be used in an electrolytic cell. Typically, the components of the diaphragm base mat will be made up as a slurry in a liquid medium, such as water. The slurry used to deposit the base mat typically comprises from about 1 to about 6 weight percent solids, e.g., from about 1.5 to about 3.5 weight percent solids of the diaphragm components in the slurry, and has a pH of between about 8 and 10. The appropriate pH may be obtained by the addition of alkali metal hydroxide, e.g., sodium hydroxide, to the slurry.

The amount of each of the components comprising the diaphragm base mat may vary in accordance with variations known to those skilled in the art. With respect to the components described in the examples of the present application, and for slurries having percent solids of between 1 and 6 weight percent, the following approximate amounts (as a percentage by weight of the total slurry) of the components in the slurry used to deposit the synthetic diaphragm base mat may be used; polyfluorocarbon fibers, e.g., PTFE fibers, —from 0.25 to 1.5 percent; polyfluorocarbon microfibrils, e.g., PTFE microfibrils, —from 0.6 to about 3.8 percent; ion-exchange material, e.g., NAFION resin, —from about 0.01 to about 0.05 weight percent; fiberglass—from about 0.06 to about 0.4 percent; and polyolefin, e.g., polyethylene, such as SHORT STUFF, —from about 0.06 to about 0.3 percent. All of the aforementioned percentages are weight percentages and are based on the total weight of the slurry.

The aqueous slurry comprising the diaphragm base mat components may also contain a viscosity modifier or thickening agent to assist in the dispersion of the solids, e.g., the perfluorinated polymeric materials in the slurry. For example, a thickening agent such as CELLOSIZE® materials may be used. Generally, from about 0.1 to about 5 percent by weight of the thickening agent can be added to the slurry mixture, basis the total weight of the slurry, more preferably from about 0.1 to about 2 percent by weight thickening agent.

A surfactant may also be added to the aqueous slurry of diaphragm base mat components to assist in obtaining an appropriate dispersion. Typically, the surfactant is a non-ionic surfactant and is used in amounts of from about 0.1 to about 3 percent, more preferably from about 0.1 to about 1 percent, by weight, basis the total weight of the slurry. Particularly contemplated nonionic surfactants are chloride capped ethoxylated aliphatic alcohols, wherein the hydrophobic portion of the surfactant is a hydrocarbon group containing from 8 to 15, e.g., 12 to 15, carbon atoms, and the average number of Ethoxylate groups ranges from about 5 to 15, e.g., 9 to 10. An example of such nonionic surfactant is AVANEL® N-925 surfactant (a product of BASF Corporation).

Other additives that may be incorporated into the aqueous slurry of the diaphragm base mat forming components include antifoaming amounts of an antifoaming agent, such as UCON® LO-500 antifoaming compound (a product of Union Carbide Corp.), to prevent the generation of excessive foam during mixing of the slurry, and an antimicrobial agent to prevent the digestion of the cellulose-based components by microbes during storage of the slurry. An appropriate antimicrobial is UCARCIDE® 250, which is available from Union Carbide Corporation. Other antimicrobial agents known to those skilled in the art may be used. Antimicrobials may be incorporated into the base mat slurry in amounts of from about 0.05 to about 0.5 percent by weight, e.g., between about 0.08 and about 0.2 weight percent.

The diaphragm base mat may be deposited from a slurry of diaphragm base mat components directly upon a liquid permeable solid substrate, for example, a foraminous cathode, by vacuum deposition, pressure deposition, combinations of such deposition techniques or other techniques known to those skilled in the art. The liquid permeable substrate, e.g., foraminous cathode, is immersed into the slurry which has been well agitated to insure a substantially uniform suspension of the diaphragm components and the slurry drawn through the liquid permeable substrate, thereby to deposit the components of the diaphragm as a base mat onto the substrate.

Typically, the base mat slurry is drawn through the substrate with the aid of a vacuum pump. It is customary to increase the vacuum as the thickness of the diaphragm base mat layer deposited increases, e.g., to a final vacuum of 15 inches (381 mm) or 20 inches (508 mm) of mercury. The liquid permeable substrate is withdrawn from the slurry, usually with the vacuum still applied to insure adhesion of the diaphragm base mat to the substrate and assist in the removal of excess liquid from the diaphragm mat. The weight density of the diaphragm base mat typically is between about 0.35 and about 0.55 pounds per square foot (1.71–2.68 kg/square meter), more typically between about 0.38 and about 0.42 pounds per square foot (1.85–2.05 kg/square meter) of substrate. The diaphragm mat will generally have a thickness of from about 0.075 to about 0.25 inches (0.19–0.64 cm), more usually from about 0.1 to about 0.15 inches (0.25–0.38 cm).

In an embodiment of the present invention, after removal of excess liquid present on the diaphragm base mat, and while the mat is still wet, i.e., the diaphragm base mat is not permitted to dry completely, inorganic particulate material is deposited on and within the diaphragm base mat. It is the exposed face of the diaphragm base mat upon which this deposition occurs, i.e., the surface facing the anode or anolyte chamber. One surface of the diaphragm base mat is adjacent to the foraminous cathode structure and therefore, only the opposite surface of the diaphragm mat, i.e., the exposed surface, is available for deposition.

In another embodiment of the method of the present invention, the diaphragm base mat formed in step (a) is dried prior to step (b) wherein the liquid slurry comprising an aqueous medium and inorganic particulate material is drawn therethrough, as previously described herein. This additional drying step further improves the surface uniformity of the inorganic material deposited on and within the diaphragm base mat. While not intending to be bound by any theory, it believed that the additional drying step between steps (a) and (b) increases the pore size of the diaphragm base mat and allows the inorganic material to penetrate deeper and lay down more uniformly upon the base mat.

The additional drying step between steps (a) and (b) may be conducted at a temperature less than that of the sintering or melting temperature of the synthetic polymeric material of the diaphragm base mat. However, the liquid slurry from which the diaphragm base mat is formed often further comprises a surfactant, e.g., a non-ionic surfactant. As such, the temperature of the additional drying step is more typically less than the temperature at which decomposition by-products of the surfactant are formed. The temperature of the additional drying step may range between any combination of values recited further herein with reference to drying step (c) of the method of the present invention.

In accordance with the method of the present invention, after the liquid topcoat slurry has been drawn through the diaphragm base mat formed in step (a), the resultant liquid-permeable asbestos-free diaphragm is dried. The resultant diaphragm is typically dried at a temperature that is less than that which would result in decomposition of the various components of the diaphragm, e.g., the synthetic polymeric material of the base mat. The liquid-permeable asbestos-free diaphragm is typically dried at a temperature of from 25° C. to 110° C.

Drying is typically conducted over a period of time sufficient to result in substantial removal of water from the diaphragm. Generally, drying is conducted in an air circulating oven over a period of 3 to 20 hours. To assist in the drying of the diaphragm, air is typically pulled through the diaphragm by attaching it to a vacuum system. As the diaphragm dries and becomes more porous, the vacuum is usually observed to drop. Initial vacuums of from 1 inch (25 mm) of mercury to 20 inches (508 mm) of mercury may be used.

When the aqueous medium of the liquid topcoat slurry comprises a wetting amount of organic surfactant, drying step (c) is preferably conducted at a temperature less than the temperature at which decomposition by-products of the organic surfactant are formed. While not intending to be bound by any theory, it is believed that surfactant decomposition by-products can contribute to foaming of the anolyte when synthetic diaphragms containing such by-products are used in chlor-alkali cells. The exact nature of these decomposition by-products has not been determined definitively.

When the aqueous medium of the topcoat slurry comprises a wetting amount of organic surfactant, the temperature or range of temperatures used to dry the resultant diaphragm will depend on the nature of the surfactant(s) used. To avoid forming surfactant decomposition by-products, the drying temperature of step (c) is typically from 25° C. or 40° C. to 100° C., e.g., from 45° C. to 80° C. or from 50° C. to 75° C.

The diaphragms of the present invention are liquid permeable, thereby allowing an electrolyte, such as sodium chloride brine, subjected to a pressure gradient to pass through the diaphragm. Typically, the pressure gradient in a diaphragm electrolytic cell is the result of a hydrostatic head on the anolyte side of the cell, i.e., the liquid level in the anolyte compartment will be on the order of from about 1 to about 25 inches (2.54–63.5 cm) higher than the liquid level of the catholyte compartment. The specific flow rate of electrolyte through the diaphragm may vary with the type of the cell, and how it is used. In a chlor-alkali cell the diaphragm should be able to pass from about 0.001 to about 0.5 cubic centimeters of anolyte per minute per square centimeter of diaphragm surface area. The flow rate is generally set at a rate that allows production of a predetermined, targeted alkali metal hydroxide concentration, e.g., sodium hydroxide concentration, in the catholyte, and the level differential between the anolyte and catholyte compartments is then related to the porosity of the diaphragm and the tortuosity of the pores. For use in a chlor-alkali cell, the diaphragm will preferably have a permeability similar to that of asbestos-type and polymer modified asbestos diaphragms.

The present invention is more particularly described in the example that follows, which is intended to be illustrative only, since numerous modifications and variations therein will be apparent to those skilled in the art.

EXAMPLE

The present example describes the preparation of a liquid-permeable asbestos-free diaphragm in accordance with the method of the present invention. The use of the diaphragm in the operation of an electrolytic cell, is also described in the present example.

In the present example, all reported percentages are weight percents, unless noted otherwise or unless indicated as otherwise from the context of their use. The current efficiency of the laboratory chlor-alkali electrolytic cell is a "caustic efficiency," which is calculated by comparing the amount of sodium hydroxide collected over a given time period with the theoretical amount of sodium hydroxide that would be generated applying Faraday's Law. Unless otherwise noted, the term "sodium chloride brine" as used in this example refers to an aqueous brine containing 25 percent by weight of sodium chloride, based on the total weight of brine. The day following the day in which the electrolytic cell was started up is referred to as the first day or day 1 of cell operation, in this example.

The base-mat of the diaphragm was composed of polytetrafluoroethylene fibers and ion exchange material, and was prepared from an aqueous base-mat slurry of approximately the following weight percent composition, based on the total weight of the base-mat aqueous slurry:

- 0.33 percent by weight of CELLOSIZE ER-52M hydroxyethyl cellulose (product of Union Carbide Corp.);
- 0.10 percent by weight of 1 Normal sodium hydroxide solution;
- 0.54 percent by weight of AVANEL® N-925 nonionic surfactant (product of BASF Corporation);
- 0.06 percent by weight of UCARCIDE-250 biocide (50 weight percent aqueous glutaraldehyde antimicrobial solution, product of Union Carbide Corp.);
- 0.62 percent by weight of ¼ inch (0.64 cm) chopped 6.67 denier TEFLON polytetrafluoroethylene floc (product of E.I. DuPont deNemours & Co.);
- 0.12 percent by weight of chopped PPG DE fiberglass (product of PPG Industries, Inc.);
- 0.14 percent by weight of SHORT STUFF GA-844 polyethylene fiber (product of Minifibers Corp.);
- 1.57 percent by weight of TEFLON 60 polytetrafluoroethylene (PTFE) microfibrils having a length of 0.2–0.5 mm and a diameter of 10–15 microns, prepared in accordance with the procedure described in U.S. Pat. No. 5,030,403;
- 0.02 percent by weight of NAFION® NR-05 perfluorosulfonic acid ion exchange material (product of E.I. DuPont deNemours & Co.); and the balance, water.

The diaphragm base-mat was deposited on a 4 inch×18 inch (10.2 cm×45.7 cm) woven mild steel 6 mesh screen by drawing a portion of the described base-mat slurry through the screen under vacuum. The vacuum was gradually increased from 1 inch (25 mm) of mercury to about 15–20 inches (381–508 mm) of mercury over a period of about 10–15 minutes. The vacuum was held at 15–20 inches (381–508 mm) of mercury as needed to filter the desired amount of base mat slurry through the screen (e.g., 2.5 liters of base mat slurry). The screen was then lifted from the slurry to allow the diaphragm base-mat to drain with the vacuum continued for an additional 30–60 minutes. While continuing to draw air through the diaphragm base-mat, the base-mat and underlying screen were both dried over a period of 4 hours at a temperature of 60° C. The base mat was determined to have a weight density of 0.51 pounds (lb.)/ft$^2$ (2.49 Kg/m$^2$).

The base-mat was coated with an aqueous topcoat slurry prepared by dispersing ATTAGEL 50 attapulgite clay powder in an amount of 5 grams per liter (gpl) into de-ionized water containing 1 gpl of AVANEL® N-925 (90%) nonionic surfactant and 1 gpl of tetrasodium pyrophosphate decahydrate. The topcoat slurry contained 0.5 percent by weight of ATTAGEL 50 attapulgite clay powder, and 0.1 percent by weight of tetrasodium pyrophosphate decahydrate, percent weights being based on the total weight of the topcoat slurry.

The dried diaphragm base mat was topcoated by drawing the topcoat slurry under vacuum through the diaphragm base-mat. The vacuum during topcoating was increased and held at 21 inches (533 mm) of mercury until the screen was removed from the topcoat slurry at about 10 minutes. The diaphragm was then placed in a 60° C. oven for 4 hours. A water aspirator was used to maintain air flow through the diaphragm while it was in the oven. The topcoat weight density was estimated to be 0.040 lb./ft$^2$ (0.195 Kg/m$^2$) (dry basis) from the measured increase in dry weight before and after topcoating of the base mat.

The total diaphragm weight density (diaphragm base mat +topcoat) after drying was 0.55 lb./ft$^2$ (2.69 Kg/m$^2$). The resultant diaphragm upon being separated from the underlying screen was observed to be uniform in appearance, having no visually observable indication of surface defects, such as mud-cracking. The topcoated diaphragm was cut into 4 inch×4 inch (10 cm×10 cm) squares for use in the laboratory chlor-alkali cell of the present example.

A laboratory chlor-alkali electrolytic cell constructed of TEFLON polytetrafluoroethylene, and having an active electrode area of 9 square inches (58 square cm) was used in this example. The catholyte and anolyte compartments of the electrolytic cell each had a volume of 130 milliliters (ml). A ruthenium oxide coated titanium mesh electrode (obtained from Electrode Corporate and having the designation "EC-200") was used as the anode, and a woven mild steel 6 mesh screen electrode was used as the cathode. The cathode and anode were separated by a distance of approximately 3/16 inch (0.48 cm). The uncoated side of the liquid permeable asbestos-free diaphragm prepared as described above, was positioned in an abutting relationship with the cathode, and separated the catholyte and anolyte compartments of the cell.

Prior to start-up, deionized water was flushed through the cell for a period of about 16 hours. The deionized water was then drained from the cell, and sodium chloride brine having a pH of 5.5 was fed to the anolyte compartment at a rate of 2 ml per minute. The cell was operated continuously for 41 days at a temperature of 194° F (90° C.) and a current setting of 90 amperes {144 amperes/ft$^2$ (ASF)}.

The diaphragm prepared as described above, is by design generally too permeable to operate with a normal sodium chloride brine feed rate, i.e., it is too permeable to maintain a normal level of liquid in the cell during cell operation. Therefore, it is common to add materials to the anolyte compartment of the cell during cell operation in response to the cell's performance to adjust the permeability of the diaphragm so that it will operate at the desired liquid level and other operating parameters, such as low hydrogen levels in the chlorine gas and target caustic efficiencies. The addition of such materials during cell operation is commonly referred to as doping the cell.

During operation of the cell, a slurry of 0.3 grams of ATTAGEL 50 attapulgite clay powder and 0.1 grams of tetrasodium pyrophosphate decahydrate in about 150 ml of diluted sodium chloride brine was added to the anolyte compartment of the cell on each of the following days of continuous cell operation, days 1, 3, 6, 7, 8, 9, 10, 13, 14, 17, 21, 22, 23, 29, and 34. The doping slurries of clay, tetrasodium pyrophosphate decahydrate and sodium chloride brine used in the present example were prepared by first mixing the indicated amount of tetrasodium pyrophosphate decahydrate with 50 ml of deionized water, with agitation provided by a magnetic stir bar. The indicated amount of ATTAGEL 50 attapulgite clay powder was then added to the mixture of water and tetrasodium pyrophosphate decahydrate. About 100 ml of sodium chloride brine was then added to the mixture of deionized water, tetrasodium pyrophosphate decahydrate and clay to form the doping slurry that was added to the anolyte compartment of the cell.

A separate doping slurry of 0.1 grams of magnesium hydroxide, and 0.2 grams of ATTAGEL 50 attapulgite clay powder in about 100 ml of sodium chloride brine was added to the anolyte compartment of the cell on the 15$^{th}$ and 16$^{th}$ days of continuous cell operation. The doping slurries of magnesium hydroxide and clay were prepared by adding the indicated amounts of magnesium hydroxide and clay to about 100 ml of sodium chloride brine with agitation provided by a magnetic stir bar.

Based on daily observations of the liquid level of the anolyte compartment above the liquid level of the catholyte compartment, the cell was observed to reach steady state operation on about the 17$^{th}$ day of operation. From day 17 through day 41 of operation, the cell was found to have: an average current efficiency of 96.9 percent±0.6 percent; an average anolyte level of 7.6 inches±0.9 inches (19.3 cm±2.3 cm) above the liquid level of the catholyte compartment; an average sodium hydroxide production of 112 gpl±3 gpl; an average cell voltage of 2.92 volts±0.01 volts; and an average power consumption of 2063 DC kilowatt hours/ton of chlorine produced (KWH/T chlorine)±11 KWH/T chlorine.

Attempts were made to prepare a comparative liquid-permeable asbestos-free diaphragm in accordance with the method of the above example, in which the aqueous topcoat slurry was composed of deionized water, 1 gpl of AVANEL® N-925, and about 5 gpl of ATTAGEL 50 attapulgite clay powder (in the absence of an alkali metal polyphosphate, such as tetrasodium pyrophosphate). The resultant comparative diaphragms were observed to be non-uniform in appearance, having a mud-cracked clay topcoat, and were considered to be unsuitable for use in an electrolytic cell, such as a chlor-alkali electrolytic cell.

The present invention has been described with reference to specific details of particular embodiments thereof. It is not intended that such details be regarded as limitations upon the scope of the invention except insofar as and to the extent that they are included in the accompanying claims.

We claim:

1. A method of forming a liquid-permeable asbestos-free diaphragm for use in an electrolytic cell, comprising:

(a) forming on a foraminous structure a liquid-permeable diaphragm base mat of asbestos-free material comprising fibrous synthetic polymeric material resistant to the environment of said electrolytic cell;

(b) drawing through said diaphragm base mat a liquid topcoat slurry comprising an aqueous medium, water-insoluble inorganic particulate material, and alkali metal polyphosphate, thereby to deposit inorganic material on and within said diaphragm base mat; and (c) drying the resultant liquid-permeable asbestos-free diaphragm.

2. The method of claim 1 wherein said foraminous structure is a foraminous cathode structure, and said water-insoluble inorganic particulate material is selected from (i) oxides, borides, carbides, silicates and nitrides of valve metals, (ii) clay mineral, and (iii) mixtures of (i) and (ii).

3. The method of claim 2 wherein the valve metal of (i) is zirconium.

4. The method of claim 2 wherein said water-insoluble inorganic particulate material is clay mineral selected from kaolin minerals, montmorillonite minerals, illite minerals, glauconite, sepiolite and mixtures thereof.

5. The method of claim 4 wherein the clay mineral is attapulgite clay.

6. The method of claim 1 wherein said alkali metal polyphosphate is selected from tetraalkali metal pyrophosphate, alkali metal triphosphate, alkali metal tetraphosphate, alkali metal hexametaphosphate and mixtures thereof.

7. The method of claim 6 wherein said alkali metal polyphospahte is tetrasodium pyrophosphate.

8. The method of claim 1 wherein the weight ratio of water-insoluble inorganic particulate material to alkali metal polyphosphate in said topcoat slurry is from 0.5:1 to 300:1; and the water-insoluble inorganic particulate material and alkali metal polyphosphate are present in said topcoat slurry in an amount totaling from 0.5 percent by weight to 5 percent by weight, based on the total weight of said topcoat slurry.

9. The method of claim 1 further comprising drying said base mat prior to step (b).

10. The method of claim 1 wherein the aqueous medium of said liquid topcoat slurry contains a wetting amount of organic surfactant selected from the group consisting of nonionic, anionic and amphoteric surfactants and mixtures thereof, and the resultant diaphragm is dried at temperatures less than the temperature at which decomposition by-products of said surfactant are formed.

11. The method of claim 10 wherein said organic surfactant is present in an amount of from 0.01 percent by weight to 1 percent by weight, based on the total weight of said aqueous medium.

12. The method of claim 11 wherein the organic surfactant is selected from nonionic surfactants represented by the following general formula:

$$R—(OC_2H_4)_m—(OC_3H_6)_n—(OC_4H_8)_p—R_1$$

wherein R is an aliphatic hydrocarbon group containing from 8 to 15 carbon atoms; $R_1$ is hydroxyl, chloride, $C_1$ to $C_3$ alkyl, $C_1$ to $C_5$ alkoxy or phenoxy; and m, n and p are numbers of from 0 to 30, the sum of m, n and p being from 1 to 30.

13. The method of claim 12 wherein R is an aliphatic hydrocarbon group containing from 8 to 15 carbon atoms, n and p are 0, m is a number of from 5 to 15, and $R_1$ is chloride.

14. The method of claim 10 wherein said aqueous medium of said liquid topcoat slurry is substantially free of alkali metal halide and alkali metal hydroxide.

15. The method of claim 1 wherein said base mat further comprises ion-exchange material, and the fibrous synthetic polymeric material of said base mat comprises perfluorinated polymeric material.

16. The method of claim 15 wherein the fibrous synthetic polymeric material comprises polytetrafluoroethylene.

17. A method of forming a liquid-permeable asbestos-free diaphragm for use in an electrolytic cell, comprising:

(a) forming on a foraminous structure a liquid-permeable diaphragm base mat of asbestos-free material comprising fibrous synthetic perfluorinated polymeric material and ion-exchange material that are each resistant to the environment of said electrolytic cell;

(b) drawing through said diaphragm base mat a liquid topcoat slurry comprising an aqueous medium, water-insoluble inorganic particulate material, and alkali metal polyphosphate, thereby to deposit inorganic material on and within said diaphragm base mat, said aqueous medium containing a wetting amount of organic surfactant selected from the group consisting of nonionic, anionic and amphoteric surfactants, and mixtures of said surfactants; and (c) drying the resultant liquid-permeable asbestos-free diaphragm at temperatures less than the temperature at which decomposition by-products of said surfactant are formed.

18. The method of claim 17 wherein said foraminous structure is a foraminous cathode structure; the fibrous synthetic polymeric material of said base mat comprises polytetrafluoroethylene; said inorganic particulate material is selected from (i) oxides, borides, carbides, silicates and nitrides of valve metals, (ii) clay mineral, and (iii) mixtures of (i) and (ii); and said alkali metal polyphosphate is selected from tetraalkali metal pyrophosphate, alkali metal triphosphate, alkali metal tetraphosphate, alkali metal hexametaphosphate and mixtures thereof.

19. The method of claim 18 wherein said inorganic particulate material is clay mineral selected from kaolin minerals, montmorillonite minerals, illite minerals, glauconite, sepiolite and mixtures thereof; and said surfactant is selected from nonionic surfactants represented by the following general formula:

$$R—(OC_2H_4)_m—(OC_3H_6)_n—(OC_4H_8)_p—R_1$$

wherein R is an aliphatic hydrocarbon group containing from 8 to 15 carbon atoms; $R_1$ is hydroxyl, chloride, $C_1$ to $C_3$ alkyl, $C_1$ to $C_5$ alkoxy or phenoxy; and m, n and p are numbers of from 0 to 30, the sum of m, n and p being from 1 to 30.

20. The method of claim 19 wherein said clay mineral is attapulgite clay; said alkali metal polyphosphate is tetrasodium pyrophosphate; and R is an aliphatic hydrocarbon group containing from 8 to 15 carbon atoms, n and p are 0, m is a number of from 5 to 15, and $R_1$ is chloride.

21. The method of claim 20 further comprising drying said base mat prior to step (b), and wherein said liquid topcoat slurry is substantially free of alkali metal chloride and alkali metal hydroxide.

* * * * *